US008584431B2

(12) United States Patent
Secrest

(10) Patent No.: US 8,584,431 B2
(45) Date of Patent: Nov. 19, 2013

(54) CARBON FIBER WALL REINFORCEMENT SYSTEM AND A METHOD FOR ITS USE

(76) Inventor: Robert Luke Secrest, Reynoldsburg, OH (US)

( * ) Notice: Subject to any disclaimer, the term of this patent is extended or adjusted under 35 U.S.C. 154(b) by 36 days.

(21) Appl. No.: 13/006,408

(22) Filed: Jan. 13, 2011

(65) Prior Publication Data

US 2012/0180412 A1 Jul. 19, 2012

(51) Int. Cl.
*E04B 1/00* (2006.01)

(52) U.S. Cl.
USPC ..... 52/746.1; 52/514; 52/293.2; 52/745.1

(58) Field of Classification Search
USPC ..... 52/293.1, 293.2, 514, 514.5, 745.1, 52/746.1
See application file for complete search history.

(56) References Cited

U.S. PATENT DOCUMENTS 3,537,220 A * 11/1970 Ellis ..... 52/223.5
5,308,430 A 5/1994 Saito et al.
5,326,630 A 7/1994 Saito et al.
5,447,593 A 9/1995 Tanaka et al.
5,635,263 A 6/1997 Saito
5,640,825 A 6/1997 Ehsani et al.
5,845,450 A * 12/1998 Larsen ..... 52/574
6,145,260 A * 11/2000 Morton ..... 52/293.2
6,183,835 B1 2/2001 Cho et al.
6,237,292 B1 5/2001 Hegemier et al.
6,357,190 B1 * 3/2002 Florentine ..... 52/293.2
6,418,684 B1 * 7/2002 Morton ..... 52/293.2
6,692,595 B2 2/2004 Wheatley et al.
6,746,741 B2 6/2004 Wheatley
6,846,537 B2 1/2005 Wheatley et al.
6,907,697 B2 * 6/2005 Gergely et al. ..... 52/293.3
7,419,335 B1 9/2008 Cohen
7,509,777 B2 3/2009 Nakaki et al.
8,201,380 B2 * 6/2012 Hargest et al. ..... 52/745.1
2008/0160236 A1 * 7/2008 Lockwood et al. ..... 428/34.7
2008/0245599 A1 * 10/2008 Batdorff et al. ..... 180/311

* cited by examiner

*Primary Examiner* — William Gilbert
*Assistant Examiner* — Gisele Ford
(74) *Attorney, Agent, or Firm* — Muskin & Farmer, LLC; Shawn R. Farmer; Jon H. Muskin

(57) ABSTRACT

The basement wall reinforcement system comprises carbon fiber materials securely mounted to the wall being reinforced as well as to structural components at both the top and bottom of the wall. These additional connections at the top and bottom of the wall increase the capacity of the carbon fiber to prevent bowing and cracking by transferring lateral forces from the wall to these structural components. Such structural components can include foundations, basement floors, sill plates, rim joists and floor joists. The carbon fiber can be connected to these structural components by pins, epoxies and specially designed brackets.

20 Claims, 10 Drawing Sheets

CARBON FIBER WALL REINFORCEMENT SYSTEM AND A METHOD FOR ITS USE

CROSS REFERENCE TO RELATED APPLICATIONS

This application claims benefit to provisional application No. 61/294,622, which is incorporated by reference herein in its entirety.

FIELD OF THE INVENTION

The present carbon fiber wall reinforcement system is an improvement over existing carbon fiber devices used to support basement and foundation walls and prevent bowing and cracking. While it is known that carbon fiber strips can be mounted on a basement wall to provide lateral support, the attachments used at the top and bottom of each carbon fiber strip must also provide sufficient force resistance to prevent failure at these locations. A woven carbon fiber pin or similar pin can be connected to the floor and foundation to provide support at that location and a sill plate bracket can be used at the top of the wall to provide reinforcement by connecting the carbon fiber strip to the sill plate or similar structural feature of the building.

BACKGROUND

The basement walls of any building must support the weight of the entire building. Such walls are typically made from poured concrete or cinderblocks, which both have a very high resistance to the compression forces created by the weight of the building. However, these materials provide very little resistance to lateral forces created by soil and water pushing against the outside surface of the wall. With little or no support on the inside of the wall to counteract these forces, it must be capable of bearing these lateral loads itself. However, in many instances, these walls cannot withstand the magnitude of these lateral forces and can begin to bow and crack.

Many techniques have been created to combat the effects of lateral forces on basement walls. Specifically, when a basement wall is constructed, rebar or metal beams are routinely inserted into the concrete as it is poured, or as the cinder block basement walls are built. This metal provides some resistance to lateral forces, but it is often insufficient to counter strong lateral forces by itself. Additionally, these types of solutions cannot be installed after a wall has been constructed, and therefore, cannot be used to reinforce a wall after it has already been compromised by lateral forces.

Steel beams have been used to reinforce the interior sides of basement walls after they have begun to bow or crack. However, steel beams can be large and unsightly when installed along a basement wall. This can be unacceptable in finished basements, which are commonly found in modern homes and office buildings.

In order to create a more aesthetically pleasing solution to this problem, carbon fiber has been applied to wall surfaces in thin strips, which can be painted, in order to resist lateral forces exerted against the outside of the wall. Carbon fiber is a very strong material, which has proven capable of supporting basement walls subjected to extreme lateral forces. However, when carbon fiber is placed only on the surface of a wall, stress points can be created at the top and the bottom of the wall, where there continues to be no reinforcement. One solution to this problem has been to attach a Kevlar strap from the carbon fiber strip to a floor joist located above where the strip has been installed. This strap can reduce some of stress created at the top of the wall where the carbon fiber strip ends, but still allows shifting to occur and does not address the fact that there remains no support at the bottom of the wall.

What is needed is a system for reinforcing a basement wall, which can disperse the lateral forces throughout the entire wall as well as the building above it and the floor and foundation below it. These forces can be dispersed if there is a good connection between the carbon fiber strips and both the lower portion of the building located on the top of the basement wall and the basement floor and foundation at the bottom of the basement wall.

SUMMARY OF THE INVENTION

It is an aspect of the present device to provide a system to reinforce a basement wall that disperses the lateral forces throughout the entire wall including the top, bottom or both the top and bottom of the wall.

The above aspect can be obtained by a basement wall reinforcement system comprising: one or more carbon fiber strips having a first end and a second end, wherein the first end is located at a bottom of a basement wall and the second end is located above a top of the basement wall at a lower portion of a building; a pin connected to the first end of the carbon fiber strip; a hole at the base of the basement wall capable of accepting the pin; and a sill plate bracket assembly capable of securely connecting the second end of the carbon fiber strip to the lower portion of a building.

The above aspect can also be obtained by a basement wall reinforcement system comprising: one or more carbon fiber strips having a first end and a second end, wherein the first end is located at a bottom of a basement wall and the second end is located above a top of the basement wall at a lower portion of a building; a pin connected to the first end of the carbon fiber strip; and a hole at the base of the basement wall capable of accepting the pin.

The above aspect can also be obtained by a method for reinforcing a basement wall comprising: providing one or more carbon fiber strips having a first end and a second end, epoxy, one or more pins, each capable of being connected to the first end of the carbon fiber strip, one or more holes at the base of the basement wall capable of accepting the pin, and a sill plate bracket assembly capable of securely connecting the second end of the carbon fiber strip to a lower portion of a building; and installing such that one or more carbon fiber strips is connected to the basement wall with epoxy; each pin is connected both to the first end of a carbon fiber strip; each pin is also securely connected to a hole with epoxy; and the second end of the carbon fiber strip is securely connected to the lower portion of a building with a sill plate bracket assembly.

BRIEF DESCRIPTION OF THE DRAWINGS

Further features and advantages of the present device, as well as the structure and operation of various embodiments of the present device, will become apparent and more readily appreciated from the following description of the preferred embodiments, taken in conjunction with the accompanying drawings of which.

DETAILED DESCRIPTION

Figure 1:
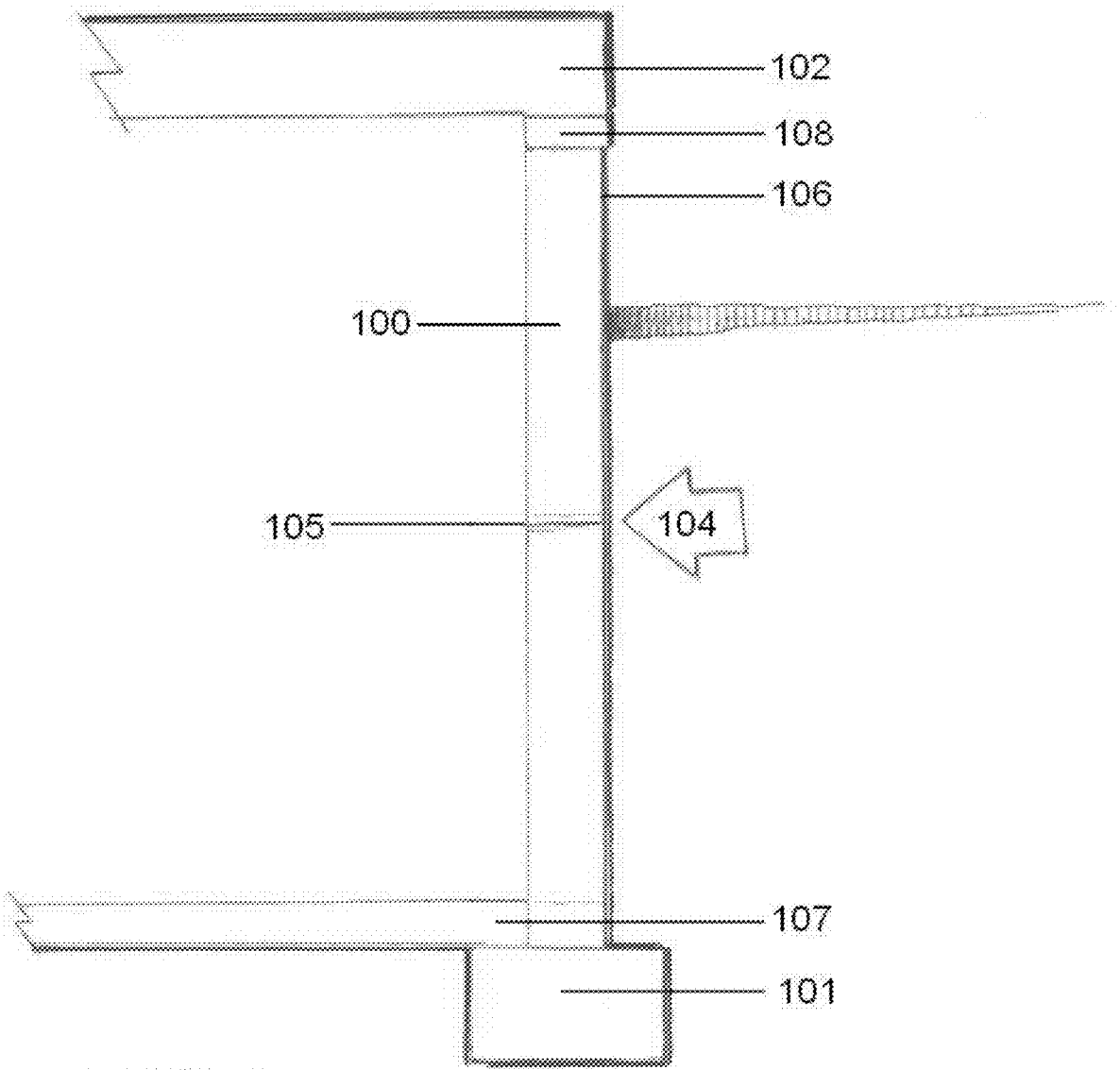
FIG. 1 is a cut-away view of a basement wall comprising no additional structural support.

This description of the exemplary embodiments is intended to be read in connection with the accompanying drawings, which are to be considered part of the entire written description. In the description, relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

Reference will now be made in detail to the presently preferred embodiments of the invention, examples of which are illustrated in the accompanying drawings, wherein like reference numerals refer to like elements throughout.

FIG. 1 is a cutaway view of a basement wall 100 comprising no additional support.

A basement wall 100 is typically located between the foundation 101 and the sill plate 108 of a building. The exterior side 106 of the basement wall 100 is in contact with the external environment, including earth and water, which can exert significant lateral forces 104 inward against the basement wall 100. Additionally, compression forces are exerted on the wall from the weight of the building being supported. An unsupported basement wall 100 will often buckle or crack 105 at its middle or at any point of weakness along the height of the wall. The wall 100 is typically weakest at its middle because that is where it receives the least amount of lateral support from either the basement floor 107 and foundation 101 at its bottom or the weight of the building through the sill plate 108 and floor joists 102 at its top.

Figure 2:
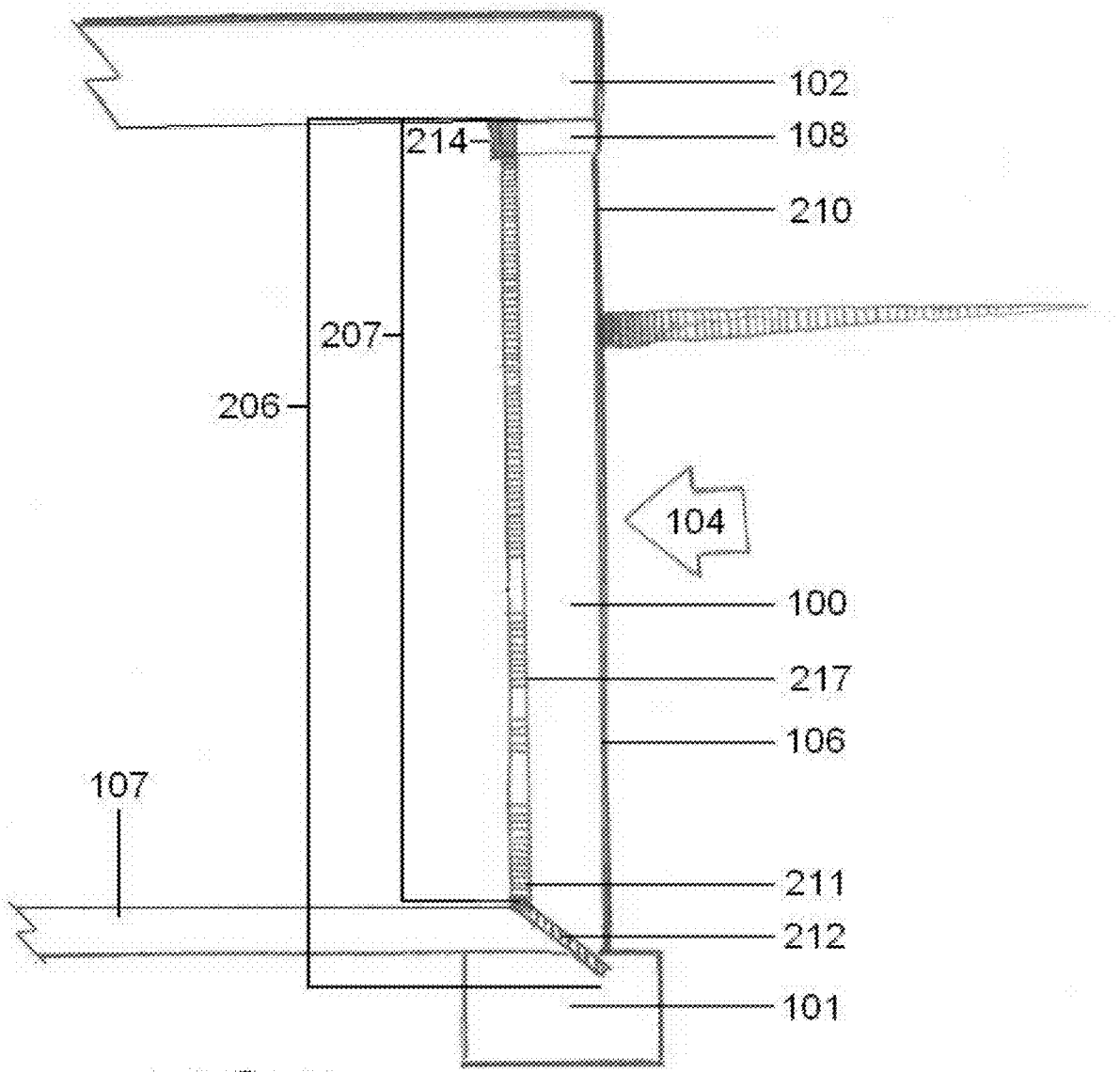
FIG. 2 is a cut-away view of a basement wall equipped with a carbon fiber wall reinforcement system comprising reinforcements at both the top and bottom of the basement wall, according to an embodiment.

FIG. 2 is a cut-away view of a basement wall 100 equipped with a carbon fiber wall reinforcement system 206 comprising reinforcements at both the top 210 and bottom 211 of the basement wall 100, according to an embodiment.

The present carbon fiber wall reinforcement system 206 can comprise a carbon fiber strip 207 connected to the interior surface 217 of the basement wall 100, which can act to support the wall 100 and help it resist buckling and cracking due to lateral forces 104 exerted against the exterior side 216 of the wall 100. The use of carbon fiber strips 207 to reinforce basement walls is known. However, mounting one or more carbon fiber strips to the surface of a wall 100 can transfer additional lateral forces, to both the top 210 and bottom 211 of the wall 100, which is not reinforced by the addition of the carbon fiber strip 207 alone. The result being failure of the wall 100 at either its top 210 or bottom 211.

The present carbon fiber wall reinforcement system 206 can solve this problem by providing additional support at both the top 210 and the bottom 211 of the basement wall 100. The bottom 211 of the wall 100 can be reinforced by securely connecting the carbon fiber strip 207 to the foundation 101 or basement floor 107 through the use of a pin 212, or similar device known to those of ordinary skill in the art of manufacturing building materials. The top 210 of the wall 100 can be reinforced by securely connecting the carbon fiber strip 207 to a lower portion of a building, which can include the sill plate 108, floor joists 102, rim joist (not pictured), or other similar structural feature using a specially designed sill plate bracket assembly 214.

Figure 3A:
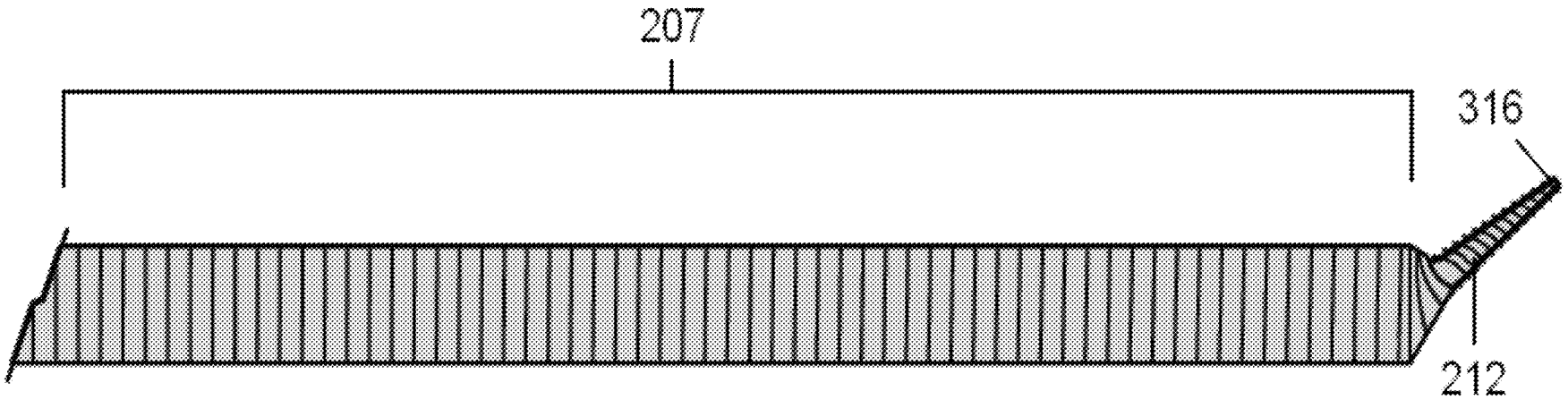
FIG. 3A is a front view of a carbon fiber strip connected to a pin, according to an embodiment.

FIG. 3A is a front view of a carbon fiber strip 207 connected to a pin 212, according to an embodiment.

The carbon fiber strip 207 can be approximately 4 to 12 inches wide in a preferred embodiment and can be any length necessary to reach from the bottom of the basement wall (not pictured) to the sill plate (not pictured). The carbon fiber strip 207 can be cut to fit any wall height prior to being installed, but will typically be 8 to 10 feet in length. In a preferred embodiment, the carbon fiber fabric comprising both the carbon fiber strip 207 and the pin 212 can be woven and multidirectional, but unidirectional carbon fiber fabric can also be used. In a preferred embodiment, the carbon fiber strip 207, the pin 212, or both can be comprised of one piece of carbon fiber fabric. However, in an alternative embodiment, the carbon fiber strip 207, the pin 212, or both can be comprised of more that one piece of carbon fiber fabric.

In a preferred embodiment, the pin 212 can be 1 to 3 inches in diameter where it connects to the strip 206 and taper down to a diameter of ¼ to 1½ inches at its tip end 316 and can be approximately 6 to 12 inches in length. Although these dimensions are preferred, other suitable dimensions can be used so long as they are sufficient to counteract the lateral forces being exerted on the wall being reinforced.

Figure 3B:
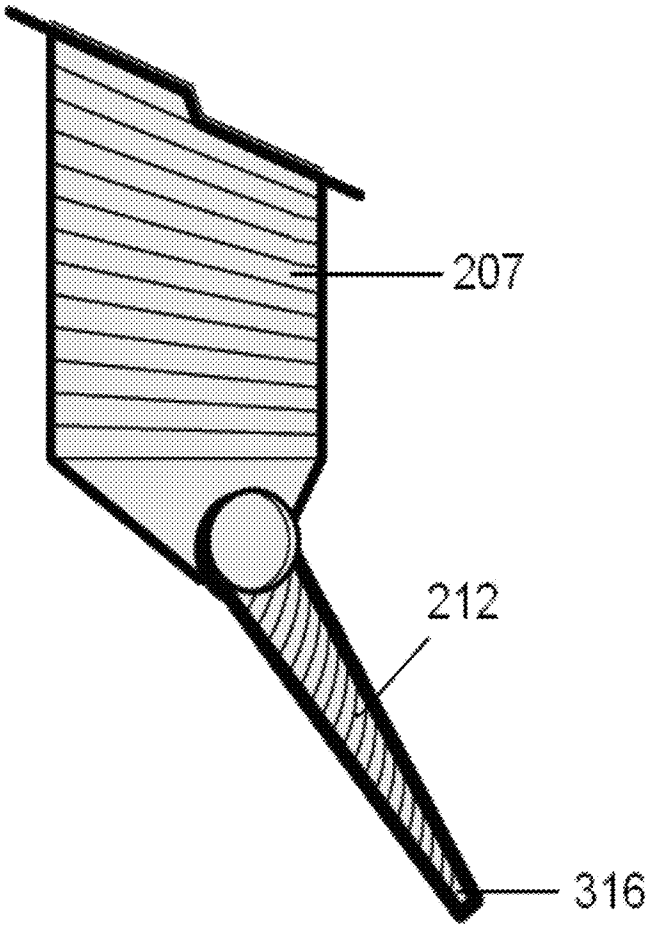
FIG. 3B is a close-up view of the bottom section of a carbon fiber strip, connected to a pin, according to an embodiment.

FIG. 3B is a close-up view of a bottom section of a carbon fiber strip 206, connected to a pin 212, according to an embodiment.

The pin 212 can be an extension of the carbon fiber strip 207, wherein the pin 212 is formed by twisting the bottom of the carbon fiber strip 207 thereby creating a taper and pointed tip end 316, which can then be set and hardened with an epoxy. In an alternative embodiment, the pin is not hardened with an epoxy, but is placed into the hole dry and epoxy is then injected into the hole. In addition to providing a seamless connection to the carbon fiber strip 207, the taper and pointed tip end 316 of the pin 212 can ease its insertion into a hole drilled at the bottom 211 of the basement wall where the carbon fiber strip 207 is being installed. In an additional alternative embodiment, the pin section 212 can be loose carbon fiber rather than be twisted, which can be hardened and solidified during the installation process. In other alternative embodiments, the pin section 212 can be comprised of one or more metals, polymers, fabrics, or any other suitable material known to those skilled in the art, which is sufficiently strong and can be connected to a carbon fiber strip 207. This pin 212 can provide additional strength to the bottom of the carbon fiber wall reinforcement system 206 thus preventing a buildup of forces at the bottom 211 of the wall 100.

Figure 4:
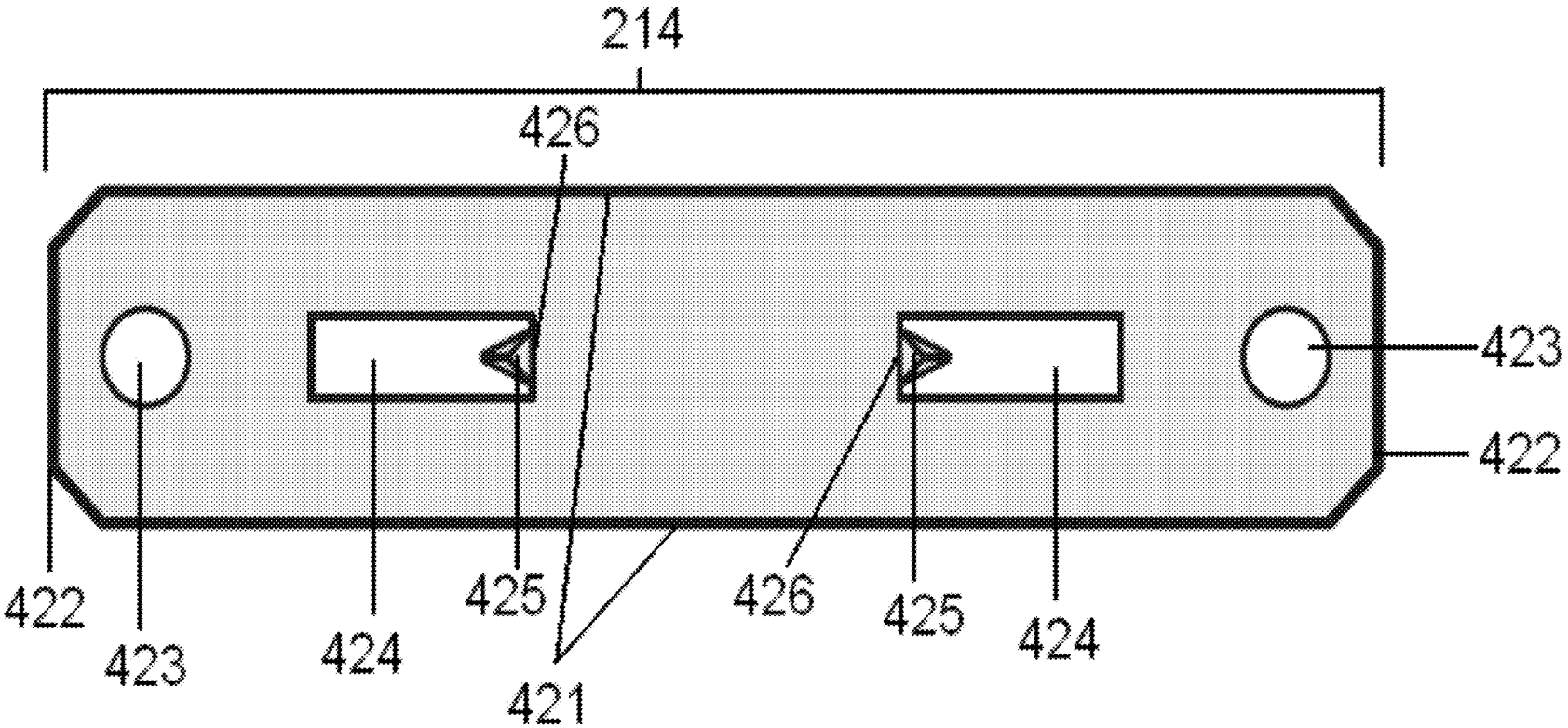
FIG. 4 is a top perspective view of a sill plate bracket which can be used to attach a carbon fiber strip to a sill plate or similar structural feature, according to an embodiment.

FIG. 4 is a top perspective view of a sill plate bracket 214 which can be used to attach a carbon fiber strip to a sill plate or similar structural feature, according to an embodiment.

A sill plate bracket 214 can be used to attach a carbon fiber strip 207 to a sill plate of a building. Preferably, the sill plate bracket 214 can be made of stainless steel or any other suitably strong and corrosion resistant material known to a person skilled in the art of building materials, including metals and polymers. The sill plate bracket 214 can be elongated comprising two long sides 421 of approximately 6 inches in length and two short sides 422, of approximately 2 inches in length. However, any length and width sufficient to hold the carbon fiber strip in place and attach it securely to the sill plate can also be used. The sill plate bracket 214 can also comprise one or more pilot holes 423, wherein one can be located at each end of the sill plate bracket 214. These holes 423 can be ⅜ inch in diameter in a preferred embodiment and can be used in conjunction with attachment mechanisms, such as bolts, lag bolts, screws, or nails. In an alternative embodiment, the pilot holes can be replaced by slots. The sill plate bracket 214 can also comprise two cutouts 424 which can provide the material for creating two spikes or prongs 425, which can grip a carbon fiber strip, thus allowing the sill plate bracket 214 to firmly attach the carbon fiber strip to the sill plate or a similar suitable location. The two cutouts 425 can be rectangular or triangular in shape and can be one inch long in a preferred embodiment. The material from the cutout can remain attached at the center-most edge of the opening 426 and be disconnected from the spike or prong 425 along each of its other sides. The spikes or prongs 425 can also be connected to the sill plate bracket 214 separately and do not necessarily need to be formed from the sill plate bracket 214 itself.

Figure 5:
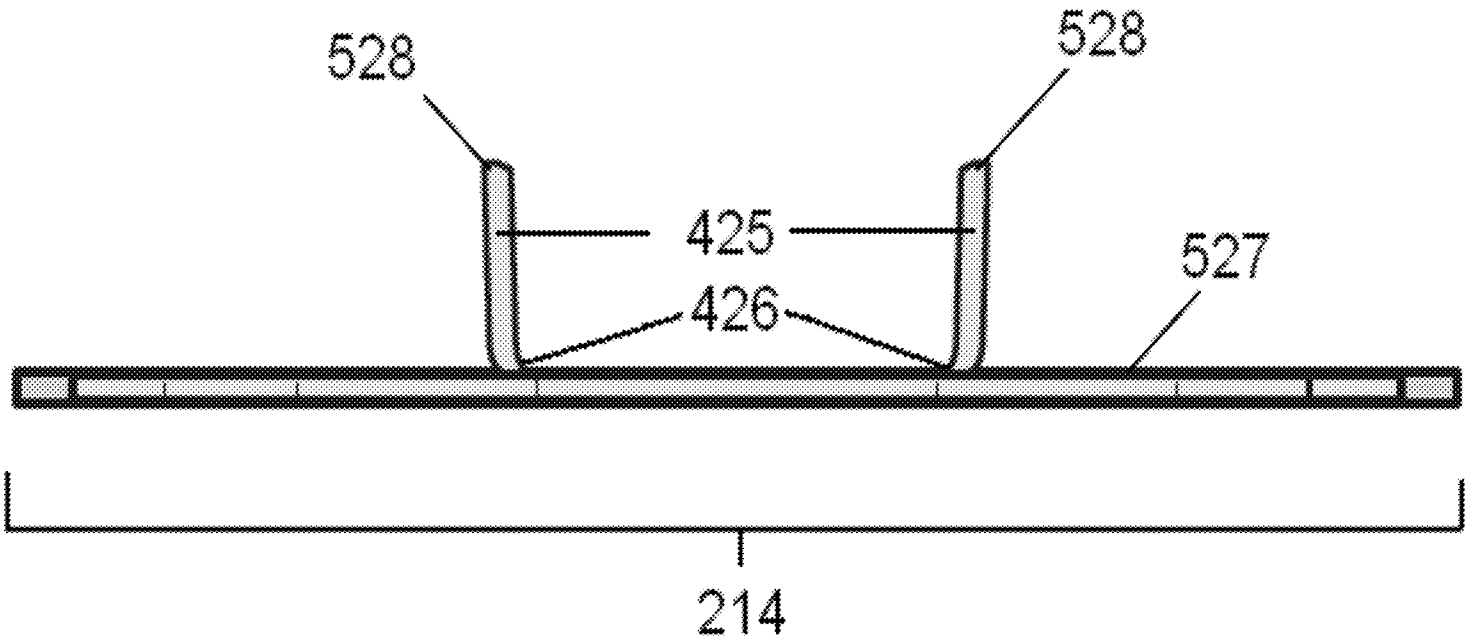
FIG. 5 is a perspective side view of a sill plate bracket which can be used to attach a carbon fiber strip to a sill plate or similar structural feature, according to an embodiment.

FIG. 5 is a perspective side view of a sill plate bracket 214 which can be used to attach a carbon fiber strip to a sill plate or similar structural feature, according to an embodiment.

The two spikes or prongs 425, which can be formed from material cutout from the sill plate bracket 214 can be folded along the attached edge 426 until they are roughly perpendicular to the top surface of sill plate bracket 527. These spikes or prongs 425 can have a pointed end 528, which can be pushed through the carbon fiber strip and into the sill plate. The sill plate bracket 214 can be used to hold the carbon fiber strip in place against the surface of the wall while it is secured through the use of an attachment mechanism.

Figure 6:
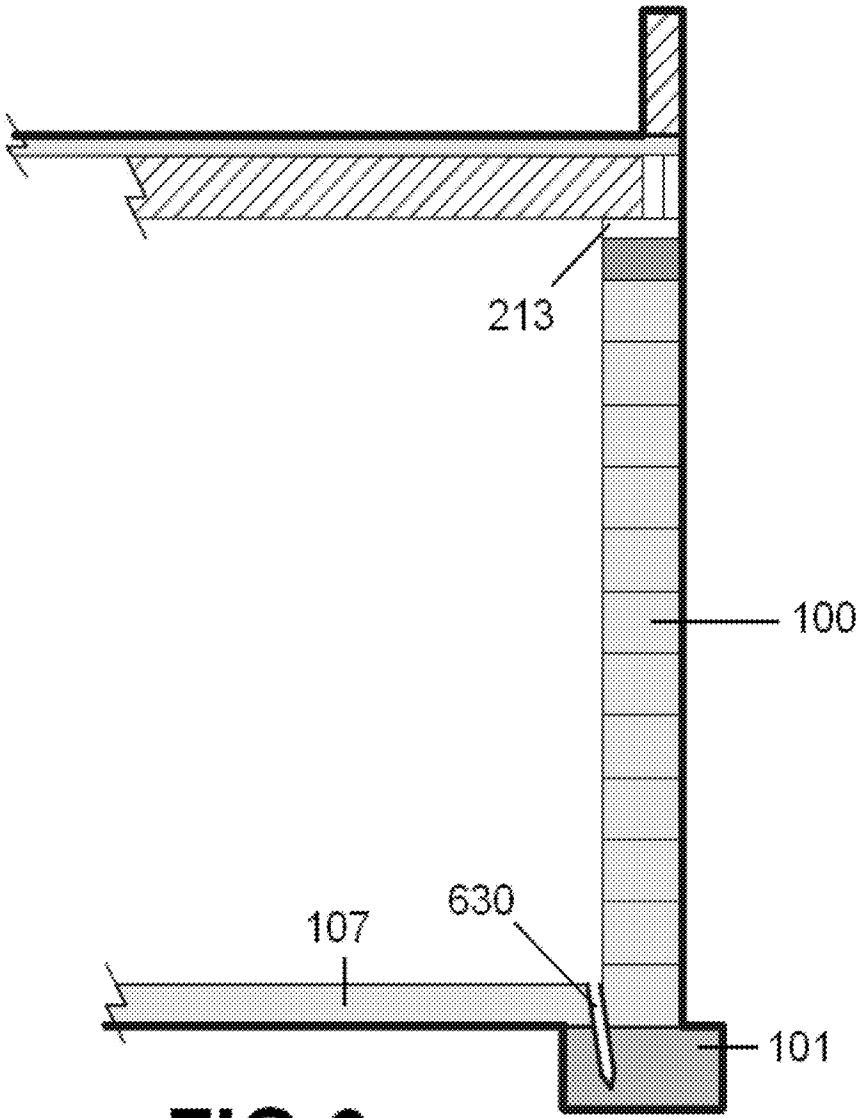
FIG. 6 is a cut-away view of a basement wall, wherein a hole for installing a pin has been drilled into a corner where a basement floor abuts the basement wall, according to an embodiment.

FIG. 6 is a cut-away view of a basement wall, wherein a hole 630 for installing a pin has been drilled into a corner where a basement floor 107 abuts the basement wall 100, according to an embodiment.

The method for installation of the carbon fiber wall reinforcement system can require a hole 630 to be drilled through the basement floor 107 and into the foundation 101 at a slight angle, such that the hole 630 extends into the foundation 101 and is located slightly below the wall 100. In some instances, particularly when the basement wall 100 is comprised of poured concrete, the hole 630 can also pass through the basement wall 100.

The installation of the carbon fiber wall reinforcement system can begin with the preparation of the wall 100. The wall 100 can be marked at the location where the strip is to be installed. The length of the carbon fiber strip can be determined by measuring the height of the wall 100 from floor to the top of the sill plate 213 and cutting the strip portion so that the flat section is equal to this height. The sill plate bracket can be placed in a location on the sill plate directly above the strip and the holes marked and drilled. In an alternative embodiment, the strip can also be connected to the sill plate 213 with epoxy. The top of the sill plate bracket can be level with the top of the sill plate 213. Care must be taken to mount the bracket evenly, because an uneven bracket can cause splitting and can damage the sill plate 213. The use of pre-drilled holes into the sill plate can ensure smooth mounting and installation.

Figure 7:
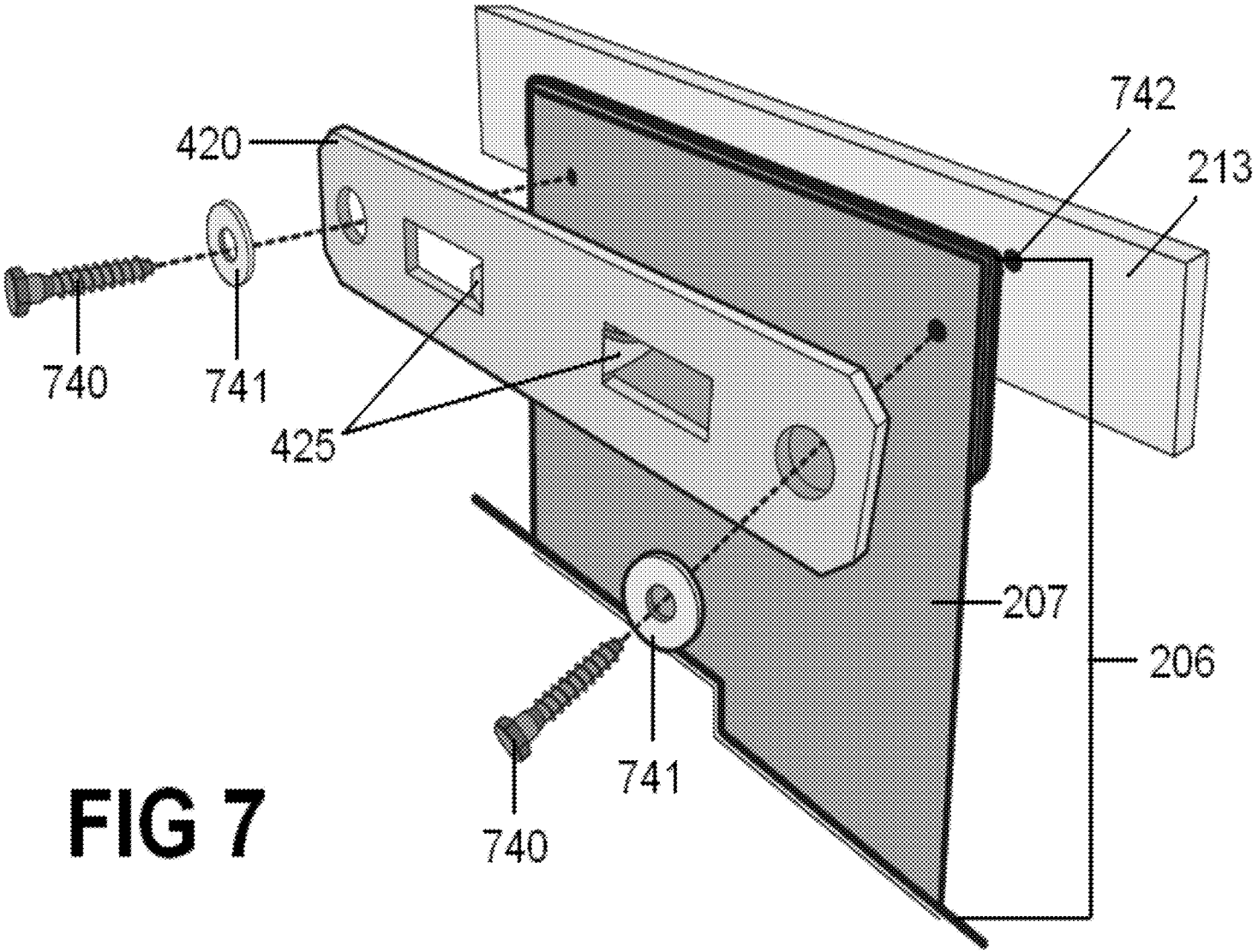
FIG. 7 is an exploded perspective view of the top of the carbon fiber strip showing how it can be attached to a sill plate using a sill plate bracket and lag bolts, according to an embodiment.

FIG. 7 is an exploded perspective view of the top of the carbon fiber strip 207 indicating how it can be attached to a sill plate 213 using a sill plate bracket 214 and lag bolts 740, according to an embodiment.

An end of the carbon fiber strip 207 can be attached to the sill plate 213 through the use of the sill plate bracket 214. The sill plate bracket 214 can be attached to the carbon fiber strip 207. The carbon fiber strip 207 can be prepared by applying epoxy to the inside of the strip 207, folding the end back on itself, applying epoxy again, folding the new end back on its self and finally adding epoxy and attaching the sill plate bracket 214. The end holding the sill plate bracket 214 is then folded back towards the carbon fiber strip 207 and the prongs 425 are pushed through the carbon fiber strip 207. The prongs 425 of the sill plate bracket 214 can face towards the sill plate 213. The sill plate bracket 214 and the carbon fiber strip 207 can be attached to the sill plate 213 through the use of two, 2 inch long lag bolts 740, which can each pass through a washer 741, the sill plate bracket 214, and the carbon fiber strip 207 by inserting them into one or more pre-drilled holes 742 in the sill plate 213. Epoxy can then be applied to all sides of the carbon fiber strip 207 to ensure a secure bond is formed with the sill plate bracket 214, the sill plate 213 and the carbon fiber support 206.

The carbon fiber strip 207 can then be lifted off of the wall 100 and epoxy can be applied to the wall 100 where the carbon fiber wall reinforcement system will be installed. After the epoxy has been applied, the carbon fiber strip 207 can be lowered onto it and coated with more epoxy, saturating it on all sides. A small amount of space can be left at the bottom of the wall to maneuver the carbon fiber pin into the pre-drilled hole. After the pin has been installed in a hole, epoxy can be applied to the area located just above the hole.

Figure 8:
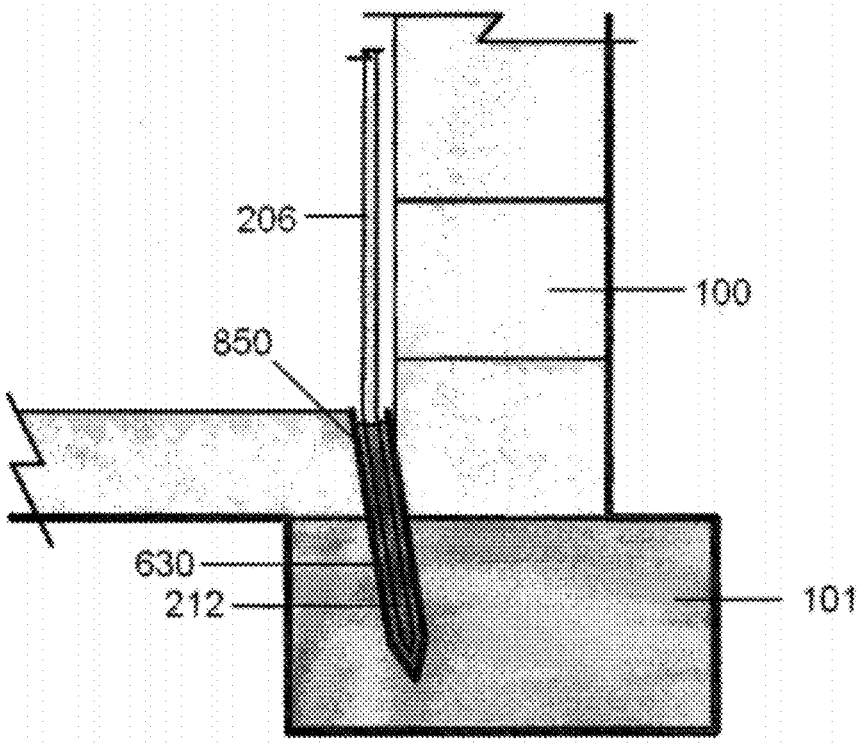
FIG. 8 is a cut-away view of a pin inserted into a hole in a corner where a basement floor abuts a basement wall, wherein the pin has been securely mounted in the hole with an epoxy, according to an embodiment.

FIG. 8 is a cut-away view of a pin 212 inserted into a hole 630 in a corner where a basement floor 107 abuts a basement wall 100, wherein the pin 212 has been securely mounted in the hole 630 with an epoxy 850, according to an embodiment.

In a preferred embodiment, the carbon fiber pin 212 can be inserted into the drilled hole 630 in the foundation 101. The pin 212, either pre-hardened or flexible, can be secured in the hole 630 through the use of an epoxy 850. In either case the epoxy 850 can be placed in the hole 630 and the pin 212 can be inserted into the epoxy-filled hole 630. If flexible, the carbon fiber can be pushed with force into the hole 630 to insure a snug fit is achieved. The epoxy 850 can be allowed to harden, thus securing the pin 212 in place in the foundation 101.

Figure 9:
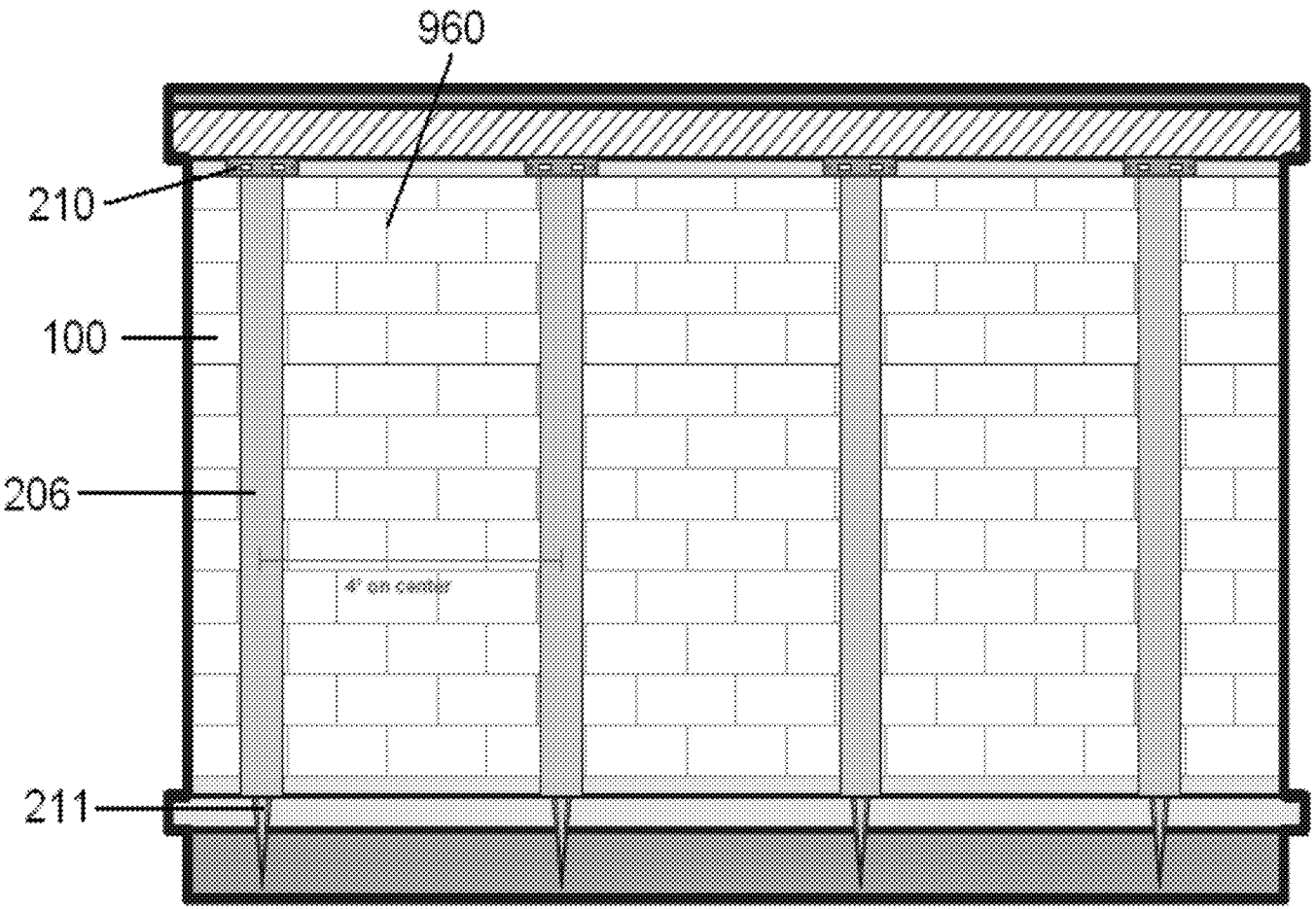
FIG. 9 is a perspective view of basement wall supported by several carbon fiber wall reinforcement systems, wherein each can be securely connected at both the top and bottom of the basement wall, according to an embodiment.

FIG. 9 is a perspective view of basement wall 100 supported by several carbon fiber wall reinforcement systems 206, wherein each can be securely connected at both the top 210 and bottom 211 of the basement wall 100, according to an embodiment.

The finished product can be painted to match the wall 100 so that it is barely visible. To support a compromised basement wall 100, the carbon fiber wall reinforcement systems 206 can be installed approximately four feet apart as measured from center to center in a preferred embodiment. Additionally, in a preferred embodiment, the carbon fiber wall reinforcement systems 206 can be mounted between mortar joints 960.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

What is claimed is:

1. A method for reinforcing a basement wall comprising:

providing one or more carbon fiber strips having a first end and a second end, epoxy, one or more pins, each formed from the first end of the carbon fiber strip, one or more holes at the base of the basement wall extending into a building foundation capable of accepting the pin, and a sill plate bracket assembly configured to securely connecting the second end of the carbon fiber strip to a lower portion of a building; and installing such that one or more carbon fiber strips is connected to the basement wall with epoxy;

each pin is securely connected to a hole with epoxy; and the second end of the carbon fiber strip is securely connected to the lower portion of a building with the sill plate bracket assembly.

2. A basement wall reinforcement system comprising:

one or more carbon fiber strips having a first end and a second end, wherein the first end is located at a bottom of a basement wall and the second end is located above a top of the basement wall and within a lower portion of a building;

a pin formed as an extension of the first end of the carbon fiber strip;

a hole configured to contain the all or part of the pin located at the base of the basement wall extending into a building foundation;

a pin secured within the hole; and a sill plate bracket assembly configured to securely connect the second end of the carbon fiber strip to the lower portion of a building.

3. The basement wall reinforcement system as described in claim 2 wherein the lower portion of a building is a floor joist.

4. The basement wall reinforcement system as described in claim 2 wherein the lower portion of a building is a rim joist.

5. The basement wall reinforcement system as described in claim 2 wherein the lower portion of a building is a sill plate.

6. The basement wall reinforcement system as described in claim 2 wherein the lower portion of a building is a sill plate.

7. The basement wall reinforcement system as described in claim 2 wherein the lower portion of the building is a floor joist.

8. The basement wall reinforcement system as described in claim 2 wherein the lower portion of a building is a rim joist.

9. The basement wall reinforcement system as described in claim 2 wherein the first end of the carbon fiber strip is rolled into a cylindrical shape to from the pin.

10. The basement wall reinforcement system as described in claim 9 wherein the pin is comprised of the first end of the carbon fiber strip is rolled into a cylindrical shape and hardened with epoxy.

11. The basement wall reinforcement system as described in claim 2 wherein the carbon fiber strip is connected to the basement wall with any epoxy.

12. The basement wall reinforcement system as described in claim 2 wherein the sill plate bracket assembly comprises a sill plate bracket further comprising at least one prong and at least one pilot hole, and at least one attachment device capable of passing through the pilot hole and securely connecting the sill plate to a lower portion of a building.

13. The basement wall reinforcement system as described in claim 12 wherein the attachment device is a lag bolt.

14. The basement wall reinforcement system as described in claim 12 wherein the attachment device is a screw.

15. The basement wall reinforcement system as described in claim 2 wherein the sill plate bracket is comprised of metal.

16. The basement wall reinforcement system as described in claim 2 wherein the pin is comprised of polymer.

17. The basement wall reinforcement system as described in claim 2 wherein the pin is comprised of metal.

18. A basement wall reinforcement system comprising:

one or more carbon fiber strips having a first end and a second end, wherein the first end is located at a bottom of a basement wall and the second end is located above the top of the basement wall and within a lower portion of a building;

a pin formed as an extension of the first end of the carbon fiber strip;

a hole configured to contain the all or part of the pin located at the base of the basement wall extending into a building foundation; and the pin located within the hole.

19. The basement wall reinforcement system as described in claim 18 wherein the lower portion of a building is a sill plate.

20. The basement wall reinforcement system as described in claim 18 wherein the Lower portion of a building is a floor joist.

* * * * *